US005245304A

United States Patent [19]

Zenmei

[11] Patent Number: 5,245,304

[45] Date of Patent: Sep. 14, 1993

[54] ELECTROMAGNETIC SWITCH FOR A STARTER MOTOR

[75] Inventor: Keisaku Zenmei, Himeji, Japan

[73] Assignee: Mitsubishi Denki Kabushiki Kaisha, Tokyo, Japan

[21] Appl. No.: 991,346

[22] Filed: Dec. 15, 1992

[51] Int. Cl.[5] ..... H01H 67/02

[52] U.S. Cl. ..... 335/126; 335/131

[58] Field of Search ..... 335/126, 131, 202; 336/192; 439/131

[56] References Cited

U.S. PATENT DOCUMENTS

| | | | |
|---|---|---|---|
| 4,990,874 | 2/1991 | Shiroyama | 335/126 |
| 5,039,967 | 8/1991 | Morishita et al. | 335/131 |
| 5,175,524 | 12/1992 | Gotoh | 335/126 |

FOREIGN PATENT DOCUMENTS 3-250518 8/1991 Japan .

*Primary Examiner*—Lincoln Donovan
*Attorney, Agent, or Firm*—Sughrue, Mion, Zinn, Macpeak and Seas

[57] ABSTRACT

An electromagnetic switch for a starter motor has a movable contact and a pair of fixed contact which are brought into contact with each other by the sliding movement of a plunger in an exciting coil; a B-terminal bolt formed integrally with one of the fixed contact, and a connecting terminal having an end surrounded by a surrounding insulation body and the other end functioning as a contacting seat portion which is fitted to the B-terminal bolt, said connecting terminal being extended in the radial direction and at a predetermined angle with respect to the insulating cap, wherein the outer configuration of the contacting seat portion of the connecting terminal is circular or a polygonal having an obtuse angle; the contacting seat of the surrounding insulation body is embedded in a resin-molded body except for its front and rear contacting surfaces; and the connecting seat portion has at its outer circumferential portion turn-prohibiting projections which are in contact with a side surface of a projection formed at the central portion of the outer surface of the insulating cap, whereby an angular position of the connecting terminal to be extended at a predetermined angle is determined with respect to the insulating cap.

2 Claims, 2 Drawing Sheets

ELECTROMAGNETIC SWITCH FOR A STARTER MOTOR

BACKGROUND OF THE INVENTION

1. Field of the Invention

The present invention relates to an electromagnetic switch for a starter motor used for vehicles or the like. More particularly, it relates to a connecting terminal attached to a B-terminal bolt of the electromagnetic switch.

2. Discussion of Background

FIG. 3 is a longitudinal cross-sectional view of a conventional electromagnetic switch for a starter motor, wherein reference numeral 1 designates an exciting coil wound on a bobbin 2, numeral 3 designates a fixed iron core for supporting an end of the bobbin 2, numeral 4 designates a casing which forms a yoke and is firmly attached with the fixed iron core 3, numeral 5 designates a plunger supported movably in the axial direction along the inner circumferential portion of the front end part of the casing 4, the plunger being made of a magnetic material so as to form a movable iron core, numeral 6 designates a return spring for the plunger 5, and numeral 8 designates a hook having its rear half portion inserted in the hole of the plunger 5 so as to be movable in the axial direction of it, the hook being made of a material such as a resin-molded material and having its front end portion with which the upper end portion of a shift lever (not shown) is engaged so that the shift lever is turned by a reciprocal movement of the hook 8.

Numeral 9 designates a compression spring for urging the hook 8 backwardly.

Numeral 10 designates a rod held in the central bore of the fixed iron core 3 so as to be movable in the axial direction, numeral 11 designates an insulating sleeve fitted to the rod 10, numeral 12 designates a movable contact fitted to the insulating sleeve 11, which is made immovable by a snap ring 14 by interposing an insulating sheet plate 13 therebetween, numeral 15 designates a compression spring exerting an urging force to the movable contact 12, numeral 16 designates an insulating cap placed in contact with the rear end of the fixed iron core 3 and firmly fixed to the casing 4 by means of caulking, and numeral 17 designates a return spring for the rod 10.

Numeral 18 designates one of fixed contacts opposing the movable contact 12. An M-terminal bolt 19 is formed integrally with the fixed contact so as to extend in parallel to the axial center line of the exciting coil 1. A connecting line to a motor is connected to the M-terminal bolt. Numeral 20 designates the other fixed contact opposing to the movable contact. A B-terminal bolt 21 is formed integrally with the other fixed contact so as to extend in parallel to the axial center line of the exciting coil 1. Numerals 22 designate toothed lock washers engaged with the terminal bolts 19, 21.

A connecting terminal 24 is connected to the B-terminal bolt 21 by fastening a nut 23. Numeral 25 designates a surround insulating body, made of a resin-molded material, in which a part of the connecting terminal 24 is embedded. A connecting wire is connected between the connecting terminal 24 and a battery (not shown). Numeral 26 is an insulating cover plate fitted to the surrounding portion of the surrounding insulation body 25 which surrounds the B-terminal bolt 21. The connecting terminal 24 is used when the connecting wire from the battery is drawn in a specified direction. The connecting terminal 24 is provided with at its one end side a contacting sheet portion **24*a*. The other end side of the connecting terminal 24 is provided with a threaded portion 24*b* and a flange portion 24*c***.

As shown in the front view of FIG. 4A, the connecting terminal 24 is extended to the direction of an angle $\theta$ with respect to a diametrical line Y—Y of the insulating cap 16. Numeral **16*a* designates a projection formed at the center of an outer edge portion of the insulating cap 16. Numeral 27 designates an S-terminal connected to a lead wire for the exciting coil 1**. The S-terminal is connected with a connecting wire from a key switch.

Numeral 28 is a connecting piece for connecting the M-terminal bolt 19 with a lead wire extending from the other end of a current coil in the exciting coil 1, wherein the lead wire is connected to the connecting piece 28 at a soldering potion 29.

It is necessary to determine the position of the connecting terminal 24 to the insulating cap 16 so as to extend at a specified angle. For this, the arrangement is made as shown in FIG. 4B which shows a front sectional view. Namely, the bottom portion **24*d* of the contacting seat portion 24*a* which is opposite the threaded portion of the connecting terminal 24 is made flat so as to be parallel to the side surface of the projection 16*a* of the insulating cap 16. The contacting seat portion 24*a* is covered by molding a resinous material to form the surrounding insulation body 25 except that both end portions 24*e* of the bottom portion 24*d* are exposed from the surrounding insulating body 25 so that the both end portions as turn-prohibiting projections are exposed out of the resinous material. The connecting terminal 24 is fitted to the B-terminal bolt 21 while the turn-prohibiting portions 24*e* are in contact with the side surface of the projection 16*a*. Then, the nut is fastened to the threaded portion, whereby the connecting terminal 24 is fixed to the B-terminal bolt 21** at a specified angle $\theta$.

The operation of the conventional electromagnetic switch will be described. When a current is supplied to the exciting coil 1, the plunger 5 is attracted toward the fixed iron core 3. Then, the hook 8 is retracted to turn the shift lever, whereby the movable contact 12 is brought to the pair of fixed contacts 18, 20 to thereby start the starter motor.

Thus, in the conventional electromagnetic switch, the position of the connecting terminal 24 is determined to direct at a specified angle $\theta$ by contacting the turn-prohibiting portions **24*e* at exposed ends of the bottom portion 24*d* of the connecting seat portion 24*a* to the side surface of the projection 16*a***. However, the conventional electromagnetic switch had the following problem. When the angular direction of drawing the connecting terminal was changed, it was necessary to prepare a new connecting terminal having a specified angle position, and thereafter, surrounding insulation body was formed by molding in which the connecting terminal was embedded.

SUMMARY OF THE INVENTION

It is an object of the present invention to provide an electromagnetic switch for a starter motor wherein only one kind of connecting terminal is used provided that the outer configuration of surrounding insulation body is changed whereby requirements of changing a drawing angle for the connecting terminal in the radial direction of the insulating cap is satisfied.

The foregoing and other objects of the present invention have been attained by providing an electromagnetic switch for a starter motor which comprises an exciting coil, a fixed iron core holding the exciting coil, a plunger attractable toward the fixed iron core in the central bore of the exciting coil by the excitation of the same, a movable contact and a pair of fixed contacts which are opened or closed by the movement of the plunger, an insulating cap surrounding the movable and the fixed contacts, an M-terminal bolt formed integrally with one of the fixed contacts to be extended in parallel to the axial center line of the exciting coil, a B-terminal bolt formed integrally with the other fixed contact to be extended in parallel to the axial center line of the exciting coil, and a connecting terminal having an end surrounded by a surrounding insulation body and the other end functioning as a contacting seat portion which is fitted to the B-terminal bolt, said connecting terminal being extended in the radial direction and at a predetermined angle with respect to the insulating cap, wherein the outer configuration of the contacting seat portion of the connecting terminal is circular or a polygonal having an obtuse angle; the contacting seat of the surrounding insulation body is embedded in a resin-molded body except for its front and rear contacting surfaces; and the connecting seat portion has at its outer circumferential portion turn-prohibiting projections which are in contact with a side surface of a projection formed at the central portion of the outer surface of the insulating cap, whereby an angular position of the connecting terminal to be extended at a predetermined angle is determined with respect to the insulating cap.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENT

Figure 1:
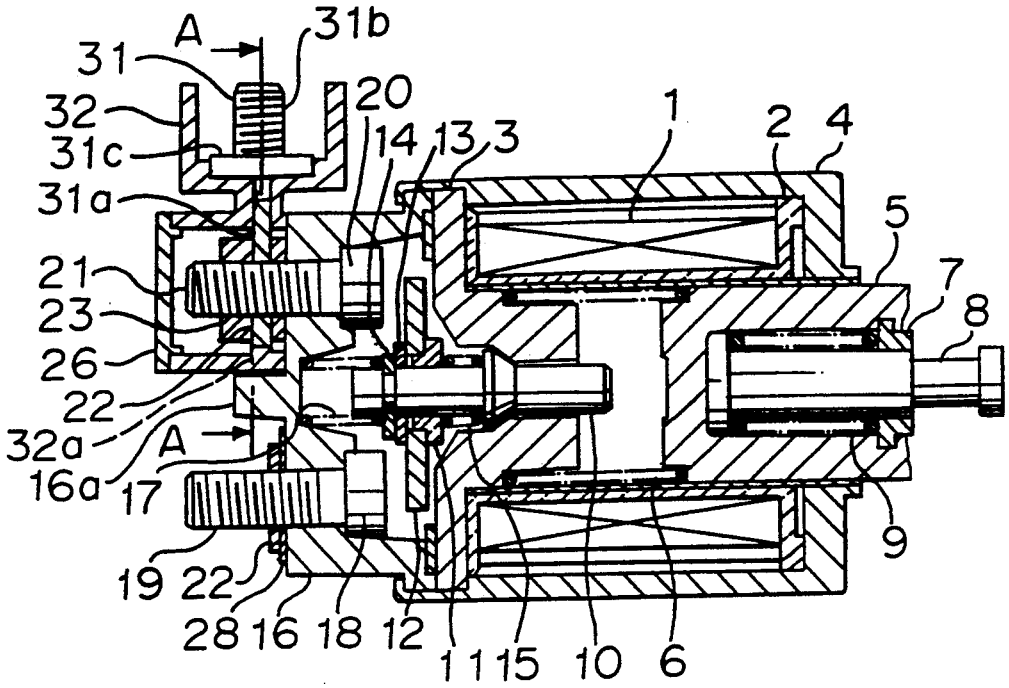
FIG. 1 is a longitudinal cross-sectional view of an embodiment of the electromagnetic switch for a starter motor according to the present invention.
Figure 3:
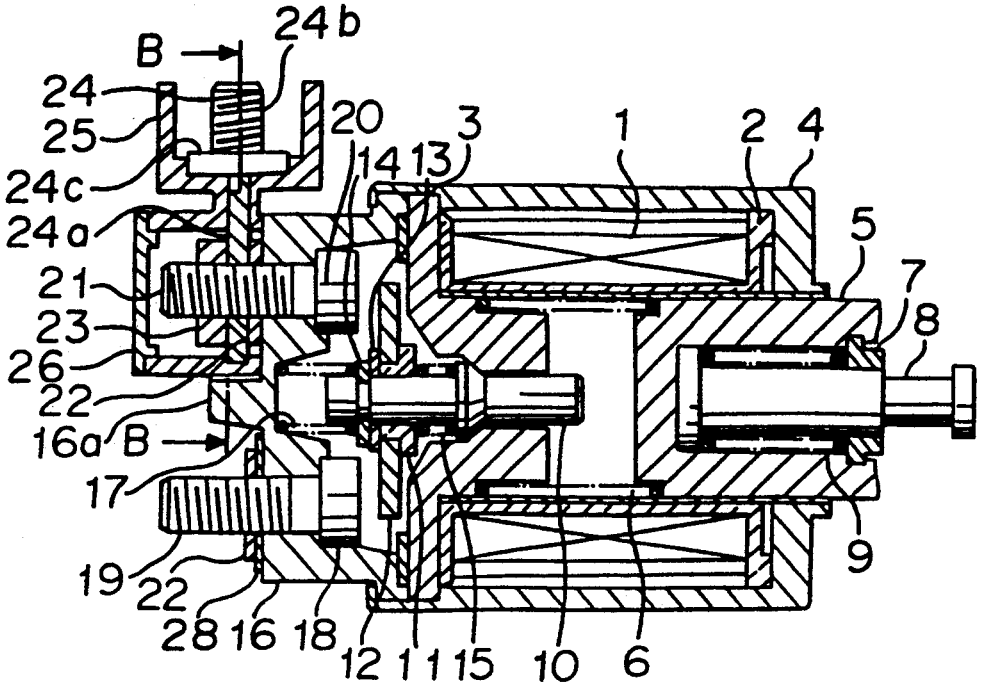
FIGURE 3 PRIOR ART
FIG. 3 is a longitudinal cross-sectional view of a conventional electromagnetic switch for a starter motor.
Figure 4:
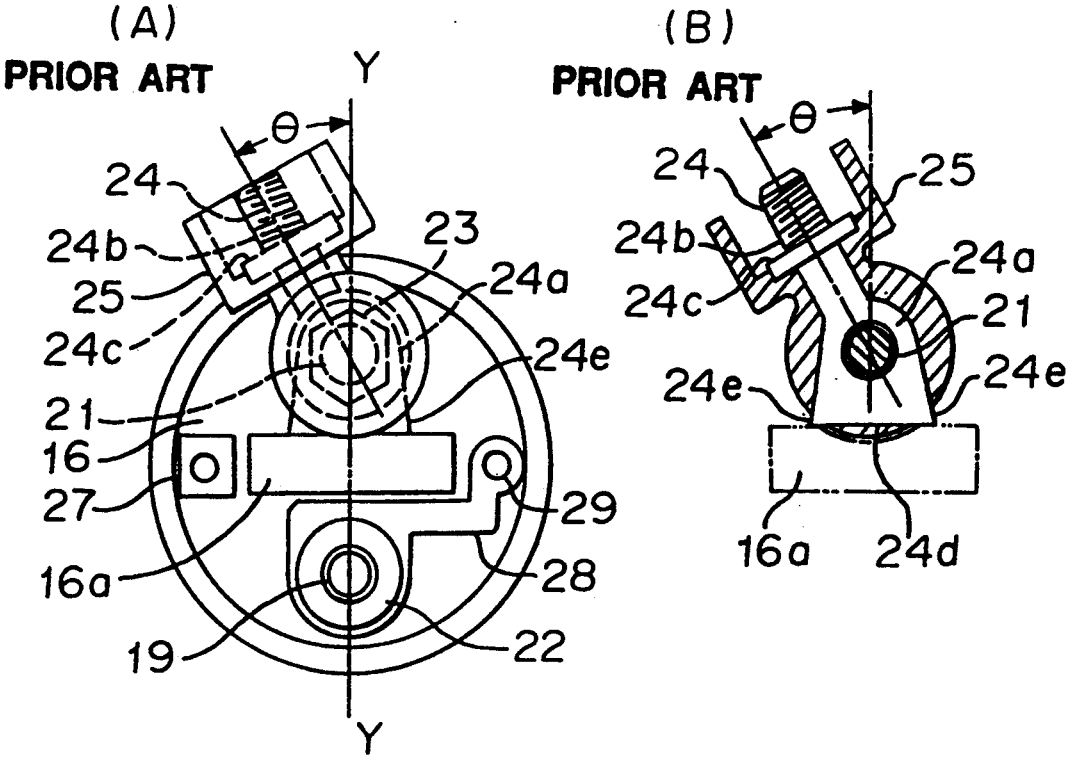
FIG. 4A is a front view of the conventional electromagnetic switch shown in FIG. 3.
FIG. 4B is a cross-sectional view taken along a line B—B in FIG. 3.

FIG. 1 is a longitudinal cross-sectional view of an embodiment of the electromagnetic switch for a starter motor according to the present invention wherein numerals 1–23, 26 and 28 designates the same parts as in FIG. 3. In FIG. 1, numeral 31 designates a connecting terminal which is surrounded by a surrounding insulating body 32 of a synthetic resin-molding product except for front and rear contacting surfaces of the connecting seat portion 31*a* which is formed at the end side opposite a threaded portion 31*b*. A flange portion 31*c* is formed in an intermediate portion of the connecting terminal 31.

Figure 2A:
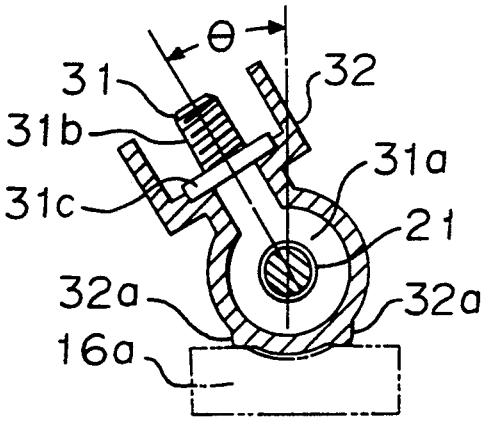
FIG. 2*a* is a cross-sectional view taken along a line A—A in FIG. 1.

As shown in the cross-sectional view of FIG. 2, a pair of turn-prohibiting projections 32*a* are formed at outer circumferential portions of the surrounding insulating body 32 in which the connecting seat portion 31*a* is embedded. The turn-prohibiting projections 32*a* have respectively flat surfaces so as to be in contact with a side surface of the projection 16*a* formed in the insulating cap 16. The turn-prohibiting projections 32*a* are so determined in position that the connecting terminal 31 is set to a predetermined angular direction $\theta$ when the turn-prohibiting projections 32*a* are brought into contact with the side surface of the projection 16*a*.

The contacting seat portion 31*a* of the connecting terminal 31 embedded in the surrounding insulation body 32 is fitted to the B-terminal bolt 21. The turn-prohibiting projections 32*a* are brought into contact with the side surface of the projection 16*a*. The nut 23 is fastened to the threaded portion 31*b*. Then, the position of the connecting terminal 31 is determined at a predetermined drawing angle $\theta$. Even when the drawing angle $\theta$ of the connecting terminal 31 is changed, it is enough to use only single kind of connecting terminal 31. In this case, resin is molded around the connecting terminal 31 to form the surrounding insulation body 32 wherein the turn-prohibiting projections 32 are formed at suitable positions to determine a predetermined drawing angle $\theta$ of the connecting terminal 31.

Figure 2B:
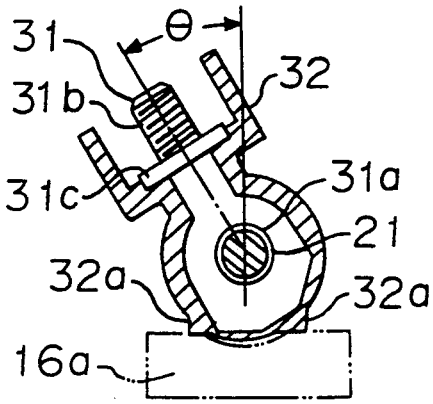
FIG. 2*b* is a cross-sectional view of a contacting seat portion according to a different embodiment from that shown in FIG. 2*a;*

In the above-mentioned embodiment, the outer configuration of the contacting seat portion 31*a* of the connecting terminal 31 is circular. However, the outer configuration may be a polygonal having an obtuse angle (as shown in FIG. 2*b*) as far as the contacting seat portion can be attached to the B-terminal bolt and can be received in the surrounding insulation body 32 without causing any trouble to the requirement of changing the drawing angle.

Thus, in accordance with the present invention, the outer configuration of the contacting seat portion of the connecting terminal to be attached to the B-terminal bolt is made circular or a polygonal having an obtuse angle; the outer circumference of the connecting terminal is embedded in the surrounding insulation body excluding the front and rear contacting surfaces, and the turn-prohibiting projections are formed in the surrounding insulation body whereby the projections are in contact with the surface of the projection in the insulating cap to prevent the connecting terminal from turning and the position of the connecting terminal is determined at a predetermined drawing angle. Accordingly, it is enough to use only one kind of connecting terminal provided that a new surround insulation body should be prepared even when the drawing angle of the connecting terminal is changed with respect to the radial direction of the electromagnetic switch. Further, the term for manufacturing an electromagnetic switch can be shortened and productivity can be improved.

Obviously, numerous modifications and variations of the present invention are possible in light of the above teachings. It is therefore to be understood that within the scope of the appended claims, the invention may be practiced otherwise than as specifically described herein.

What is claimed is:

1. An electromagnetic switch for a starter motor which comprises an exciting coil, a fixed iron core holding the exciting coil, a plunger attractable toward the fixed iron core in the central bore of the exciting coil by the excitation of the same, a movable contact and a pair of fixed contacts which are opened or closed by the movement of the plunger, an insulating cap surrounding the movable and the fixed contacts, an M-terminal bolt formed integrally with one of the fixed contacts to be extended in parallel to the axial center line of the exciting coil, a B-terminal bolt formed integrally with the other fixed contact to be extended in parallel to the axial center line of the exciting coil, and a connecting terminal having an end surrounded by a surrounding insulation body and the other end functioning as a contacting seat portion which is fitted to the B-terminal bolt, said connecting terminal being extended in the radial direction and at a predetermined angle with respect to the insulating cap, wherein the outer configuration of the contacting seat portion of the connecting terminal is circular or a polygonal having an obtuse angle; the contacting seat of the surrounding insulation body is embedded in a resin-molded body except for its front and rear contacting surfaces; and the connecting seat portion has at its outer circumferential portion turn-prohibiting projections which are in contact with a side surface of a projection formed at the central portion of the outer surface of the insulating cap, whereby an angular position of the connecting terminal to be extended at a predetermined angle is determined with respect to the insulating cap.

2. The electromagnetic switch according to claim 1, wherein the turn-prohibiting projections are constituted by a pair of projections each having a flat surface to be in contact with the side surface of the projection of the insulating cap.

* * * * *